US005584205A

United States Patent [19]

Harsch et al.

[11] Patent Number: 5,584,205

[45] Date of Patent: Dec. 17, 1996

[54] TRANSPORT SYSTEM

[75] Inventors: Erich Harsch, Weingarten; Rainer Reichenbach, Schlier, both of Germany

[73] Assignee: Mueller-Weingarten AG, Weingarten, Germany

[21] Appl. No.: 398,218

[22] Filed: Mar. 2, 1995

[30] Foreign Application Priority Data

Mar. 12, 1994 [DE] Germany ..... 44 08 449.8

[51] Int. Cl.[6] ..... B21D 43/05

[52] U.S. Cl. ..... 72/405.02; 72/405.1; 72/405.13; 72/405.16

[58] Field of Search ..... 72/405.01, 405.02, 72/405.16, 405.13, 405.12, 405.11, 405.10

[56] References Cited

U.S. PATENT DOCUMENTS

| | | | |
|---|---|---|---|
| 4,648,786 | 3/1987 | Sakurai | 72/405.1 |
| 4,970,888 | 11/1990 | Shiraishi | 72/405.1 |
| 5,140,839 | 8/1992 | Bruns | 72/405 |

FOREIGN PATENT DOCUMENTS

| | | |
|---|---|---|
| 0210745 | 2/1987 | European Pat. Off. . |
| 0556562 | 8/1993 | European Pat. Off. . |
| 0600254 | 6/1994 | European Pat. Off. . |
| 3824058 | 11/1989 | Germany . |
| 3843975 | 6/1990 | Germany . |

*Primary Examiner*—Daniel C. Crane
*Attorney, Agent, or Firm*—Spencer & Frank

[57] ABSTRACT

A transport system for transporting workpieces through machining stations of a press device. The transport system includes at least one independent transport device dedicated to each machining station, the transport device being effective for receiving and transporting a workpiece in at least one of a 2-axial and a 3-axial transport motion. The transport system includes a longitudinal transport device for effecting a horizontal longitudinal motion of the workpiece in a transport direction of the workpiece and having a horizontally extending extension arm for transporting the workpiece between machining stations. The extension arm includes guides, and a transport slide for transporting the workpiece in the transport direction. The transport slide is disposed on the guides for being longitudinally movable thereon and has coupling device thereon for coupling one of a suction beam and a gripper arrangement to the extension arm for effecting a reception of the workpiece by the longitudinal transport device. The transport system further includes: a lifting mechanism operatively connected to the longitudinal transport device for effecting a vertical motion of the workpiece; and a closing-opening mechanism operatively connected to the longitudinal transport device and the lifting mechanism for effecting a transverse motion of the workpiece with respect to the transport direction thereof.

22 Claims, 10 Drawing Sheets

A–A

B-B

C-C

E-E

F-F

TRANSPORT SYSTEM

FIELD OF THE INVENTION

The invention relates to a transport system for transporting workpieces through machining stations of a press, press line or the like.

BACKGROUND OF THE INVENTION

Where the manufacture of a workpiece calls for a plurality of work operations, then, for the economic production of the sheet-metal part, the necessary individual operations are conducted in a so-called transfer press or press line. The number of dies then corresponds to the number of work stages which are necessary for the manufacture of a multi-stage drawn part. Multiple-die or transfer presses of this type possess a transport device with which the workpieces are transported onward from one work station to the next. The longitudinal and transverse motions which are controlled by means of cam gears and any lifting motions of the transport device are derived from the primary drive and are thus synchronized with the ram motion. The basic structure of such a drive is represented in EP 0 210 745, FIG. 4. The traditional transfer system therefore practices the following functions in, respectively, two directions: gripping (transverse motion), lifting (vertical motion), conveyance (longitudinal motion).

In the manufacture of large-area sheet-metal parts, in particular, customary 3-axial transfer presses could no longer satisfactorily fulfill the holding and transport functions of the parts, since these large parts would sag too severely when transported in the gripper pliers. The so-called suction beam transfer systems were therefore developed as an alternative, in which large sheet-metal parts are fastened by means of a vacuum suction device to so-called suction beams. The suction beams or cross-ties are fastened to the supporting rails running through the transfer press, so that the transverse motion of the 3-axis system to grip the workpieces is no longer necessary. Since these suction beams, during the press cycle, cannot however travel outwards like the gripper rails in 3-axis operation with their transversely directed closing and opening motion, in this suction beam transfer a parking position for the suction beams has to be created, into which the suction beams are transported during the actual machining cycle.

In place of the longitudinal motion of the supporting rails for longitudinal transport, driven slides, trolleys or the like can also be disposed on the supporting rails, to which the cross-ties are fastened by suction devices (DE 38 24 058 C1). In this case, the supporting rails perform only a lifting motion during the transport cycle, whilst the longitudinal motion of the suction beams is effected by the slides.

Both in the 3-axis transfer of the workpieces using gripper rails and in the 2-axis transfer using supporting rails and suction beams, it is generally necessary to deposit the workpieces between the individual machining stations in so-called intermediate stations or orientation stations, which are generally located in the region of the uprights of the transfer press. In these orientation stations, the position of the workpiece can be changed in order to adapt it to the next machining stage (DE 38 43 975 C1).

The sheet-metal parts to be machined, which are becoming increasingly larger, led to the further development of the multiple-die or transfer presses into so-called large-part multiple-die presses (LP-presses), which are basically similarly constructed with the difference that, as a condition of the die size and workpiece size respectively, the transport steps turn out to be substantially larger. The use of multiple-die presses or large-part multiple-die presses accordingly enables a high production capacity, since all production steps necessary for the manufacture of a workpiece are simultaneously conducted. With each ram stroke a part is completed, irrespective of the number of work stations necessary for the manufacture in the individual case. A comparison with conventional press lines having individual presses reveals the advantage therefore, in multiple-die presses, of more compact introduction plant, lower energy costs and investment costs, as well as lower non-productive times in changing the die and in the conversion cycle.

Multiple-die presses of the stated type have the drawback, however, that a forced interlinking of all machining stations is necessary. The workpieces are guided at a specific machining rhythm through the multiple-die press, longer transport paths and hence longer transport times between the individual machining cycles being generated in respect of large-area parts and large dies associated therewith, since all press rams perform the machining cycle synchronously and simultaneously. An individual, out-of-phase and hence time-saving handling of the workpieces within the press is not therefore possible. In order to exert the high forces associated with simultaneous pressurization of the ram, the press has to be made correspondingly large.

In the known 2-axis or 3-axis drives, it is also disadvantageous that the insertion heights in the die stages are not variable, since the supporting or gripper rails can only execute a common stroke. Furthermore, as a result of the continuously common feed drive, an out-of-phase of-phase working of the die stages is not possible, which, especially where there is a large distance between the stages, owing to the long transport paths, produces poor freedom of passage.

The object of the invention is to avoid the above-stated drawbacks and, in particular, to obtain the most universal transfer drive possible for a multiple-die press and, in particular, a large-part multiple-die press or a press line or the like.

SUMMARY OF THE INVENTION

The above object is achieved, starting from a transport system for transporting workpieces through the machining stations of a press, press line or the like.

Thus, the invention pertains to a transport system which comprises at least one independent transport device dedicated to each machining station, the transport device being effective for receiving and transporting a workpiece in at least one of a 2-axial and a 3-axial transport motion. The transport system includes a longitudinal transport device for effecting a horizontal longitudinal motion of the workpiece in a transport direction of the workpiece and having a horizontally extending extension arm for transporting the workpiece between machining stations. The extension arm includes guide means, and a transport slide for transporting the workpiece in the transport direction. The transport slide is disposed on the guide means for being longitudinally movable thereon and has coupling device thereon for coupling one of a suction beam and a gripper arrangement to the extension arm for effecting a reception of the workpiece by the longitudinal transport device. The transport system further includes: a lifting mechanism operatively connected to the longitudinal transport device for effecting a vertical motion of the workpiece; and a closing-opening mechanism operatively connected to the longitudinal transport device and the lifting mechanism for effecting a transverse motion of the workpiece with respect to the transport direction thereof.

Advantageous and expedient refinements of the transport system specified above are further defined.

The invention is based upon the core concept that the transfer receives, in each die stage, a dedicated drive, which can work independently of the adjacent drive. A universal mobility of the workpiece transport between the individual machining stages is thereby obtained, in which case, because of the existing scope for positional alteration during the transport cycle, the orientation stations which are otherwise necessary are also able to be relinquished.

The invention realizes the principle of a fully independent drive in optional degrees of freedom, i.e. that the transportation of the workpiece from one to the next machining station is effected fully independently of a central drive by individually programmable drives. It is consequently no longer necessary for the ram motion of all mutually adjoining press stages to be identically effected. Rather, the transport motions of the workpieces and the machining cycles in the individual stations are able to take place in time-staggered arrangement. Naturally, the controlling of the press and, in particular, the motions of the transfer have to be designed such that no collisions occur. The motions of the individual transfer axes run, by necessity, synchronously with the press drive. The transfer, furthermore, possesses six degrees of freedom, thereby enabling existing die sets having different parts-positions to be mechanized. As a result of the individual drives of the transfer for each die stage, greater distances of the die stages from one another can be offset by phase displacements, in particular, so that even individual presses in press lines are able to be charged, without there being poorer freedom of passage owing to excessively long transport paths.

Further details and advantages of the invention are derived from the description and the appended associated drawings. The above-stated features and those yet to be described below can herein be used not only in the respectively defined combination, but also in other combinations or in isolation, without departing from the framework of the present invention.

DETAILED DESCRIPTION OF THE INVENTION

Figure 1:
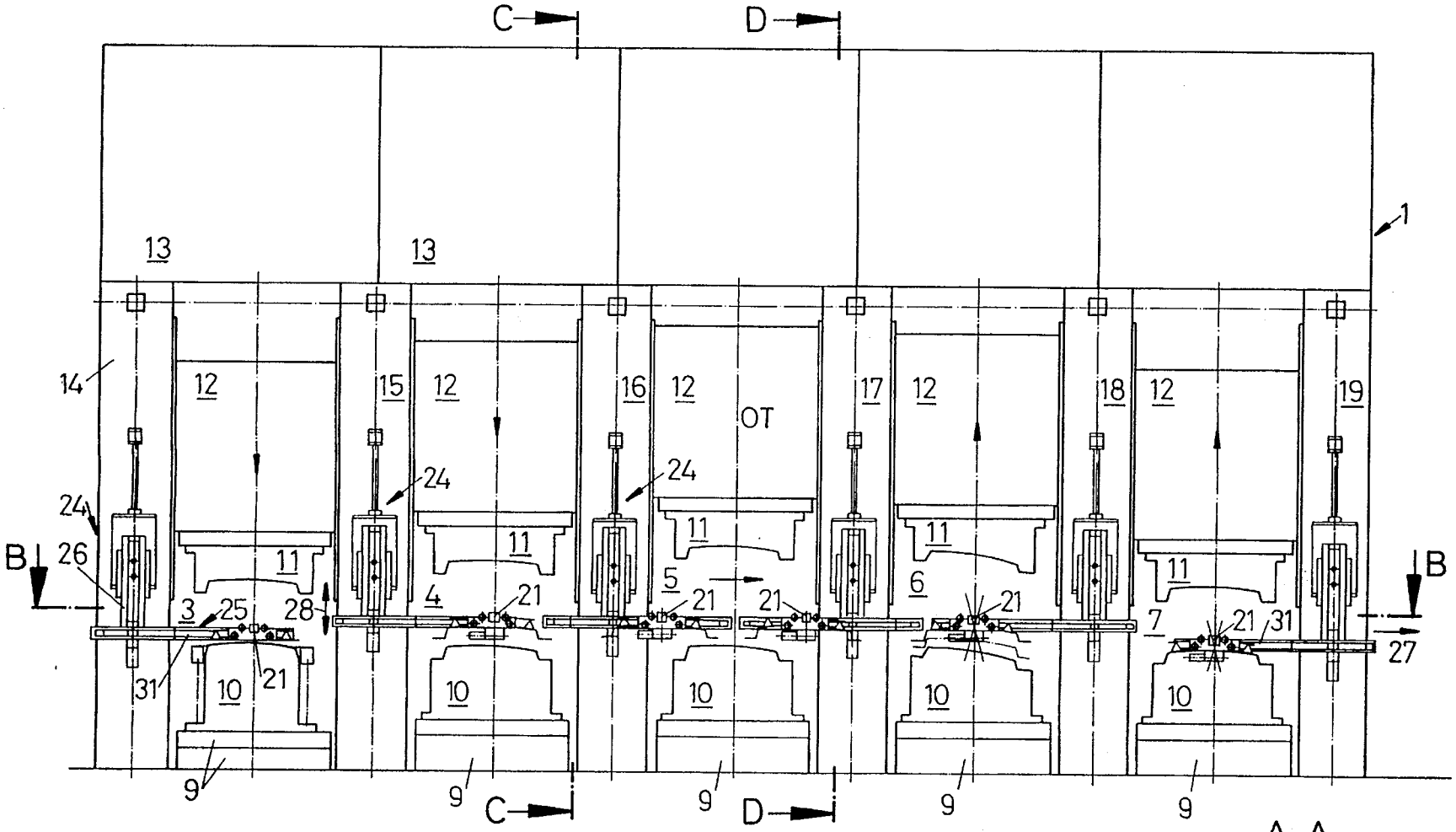
FIG. 1 shows a longitudinal section through a transfer press according to the sectional line A—A in FIG. 2.
Figure 2:
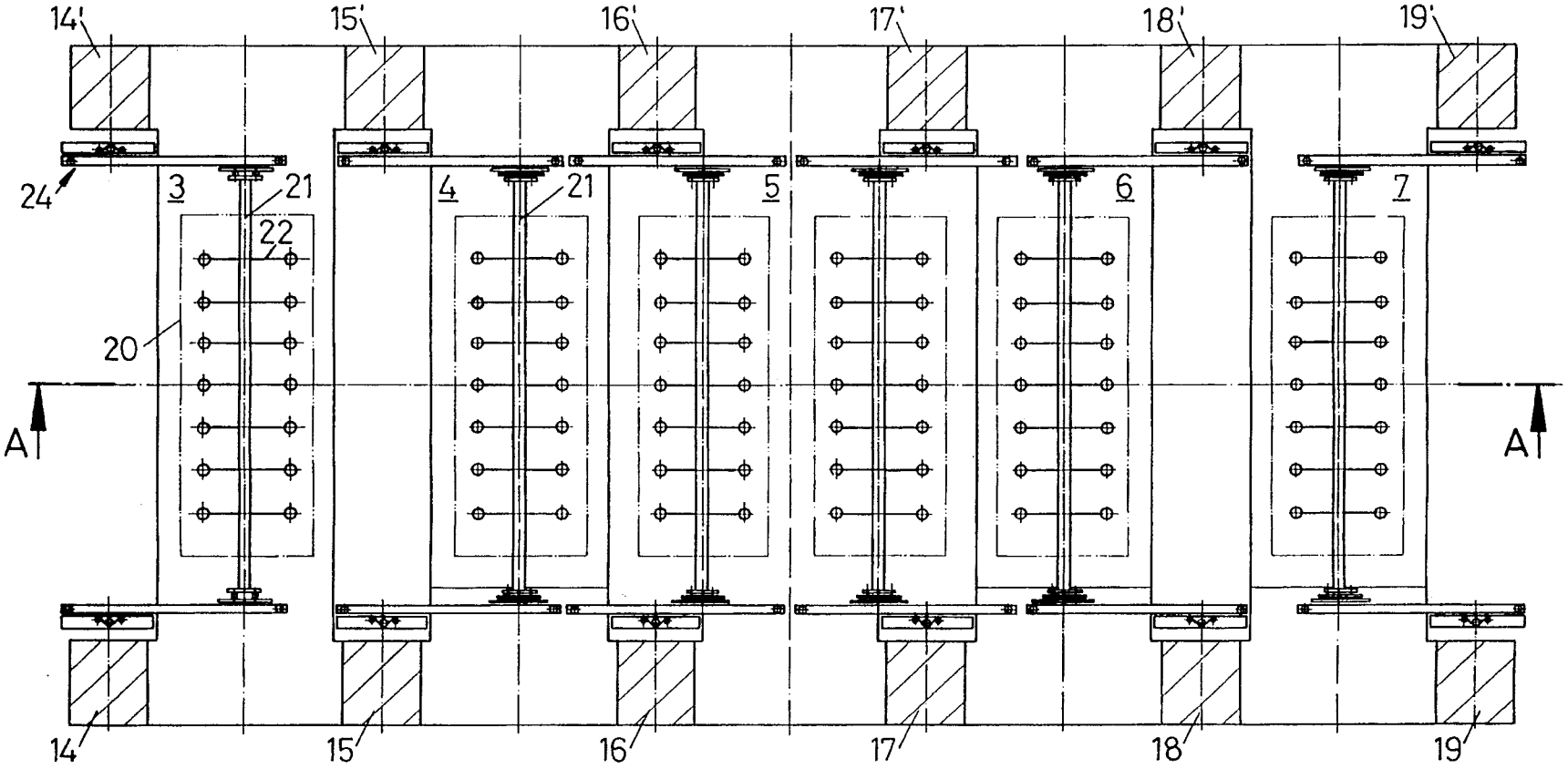
FIG. 2 shows a top view of the transfer press according to FIG. 1 along the sectional line B—B.

In FIGS. 1 and 2, there are represented in a multiple-die press 1 and, in particular, a large-part multiple-die press 1 (LP-press), by way of example, the first five machining stages 3 to 7 in side view or in longitudinal section (FIG. 1) and in top view (FIG. 2). Each machining stage 3 to 7 respectively exhibits a sliding table 9 with a bottom die 10 fastened thereon. A top die 11 is fastened in each machining stage to a press ram 12, which, for its part, is connected by a drive chain to the headpiece 13 of the press.

The headpieces 13 of the press are connected to the associated press platens (not represented) by the press uprights 14, 14' to 19, 19' which are disposed to the side of the machining station and between which the press rams of each machining stage are guided.

Figure 3:
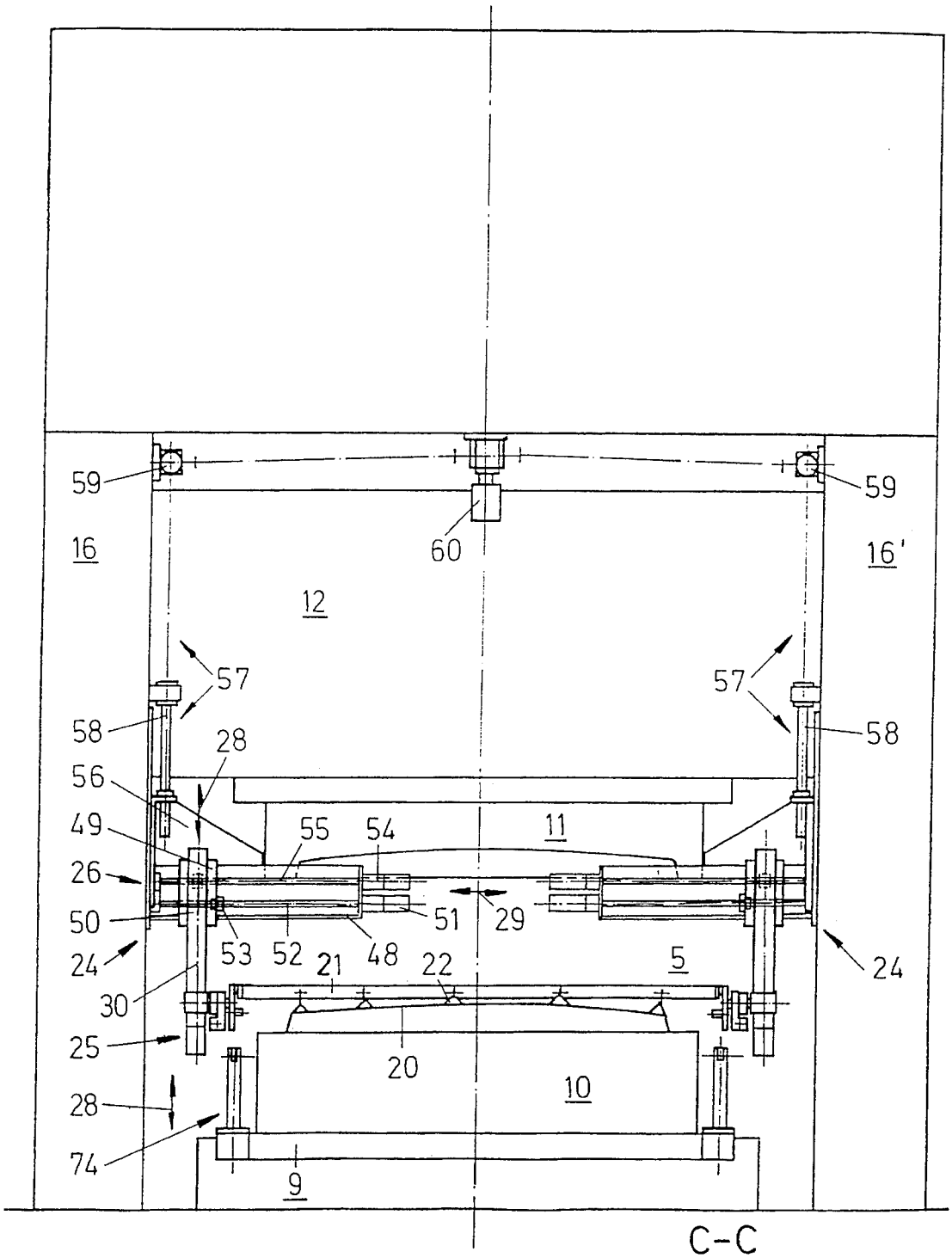
FIG. 3 shows a section along the sectional line C—C in FIG. 1, exhibiting a parts-transport with suction beams.

In the illustrative embodiment according to FIGS. 1 and 2, there is provided for the transport of the respective workpiece 20 a suction beam drive, comprising a suction beam or cross-tie 21 with suction spiders, magnet holders 22 or the like fastened thereto (see also FIG. 3).

Figure 5:
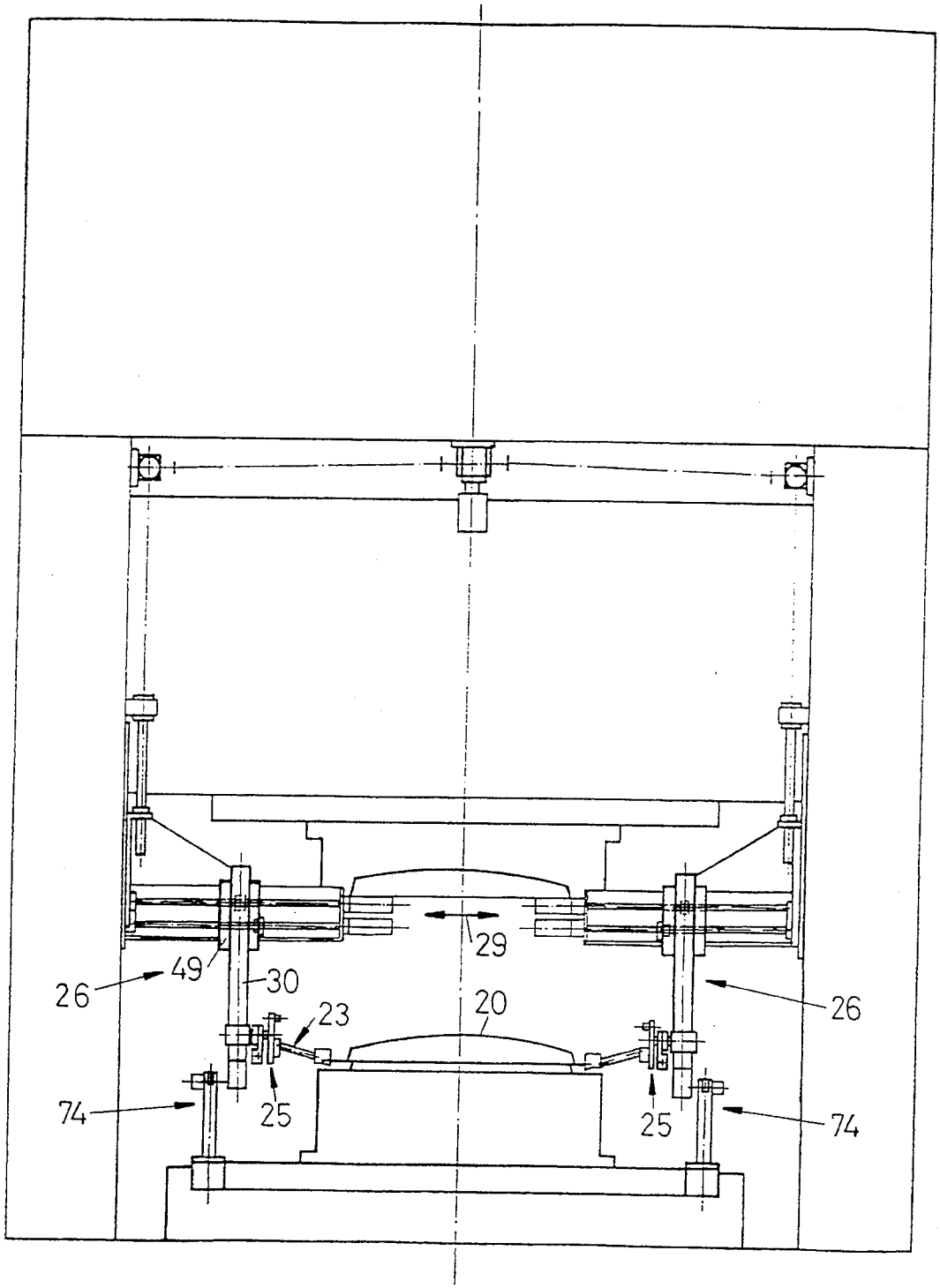
FIG. 5 shows a view in the direction of transport with a gripper transport in 3-axis operation.

In place of the suction beams 21, according to the representation according to FIG. 5, a gripper arrangement 23 running in 3-axial motion can also be provided for the lateral grasping of the workpiece 20.

Both for the generally 2-axial suction beam transport and for the 3-axial transport of the gripper arrangement 23 through the multiple-die press according to FIGS. 1 and 2, a transport system 24 is provided, which is installed as an independent workpiece transport unit for each machining stage 3 to 7. Each transport system 24 herein comprises a first longitudinal transport device 25, for performing the horizontal longitudinal motion in the direction of transport 27 of the workpiece, and a second lifting/transverse motion device 26, for performing a lifting motion in the vertical direction 28 and where appropriate, a necessary transverse motion 29, which can sometimes be necessary in 3-axis operation as a work axis or in 2-axis operation as a set-up axis. The press according to the invention can consequently be run in 2-axial operation or in 3-axial operation with suction beam drive or gripper arrangement. This enables different press systems to be realized within a single press.

To begin with, the longitudinal transport device 25 of the transport system 24 is explained in greater detail below, reference being made to FIGS. 1 to 3 and FIGS. 8*a* to 8*c*.

Figure 8A:
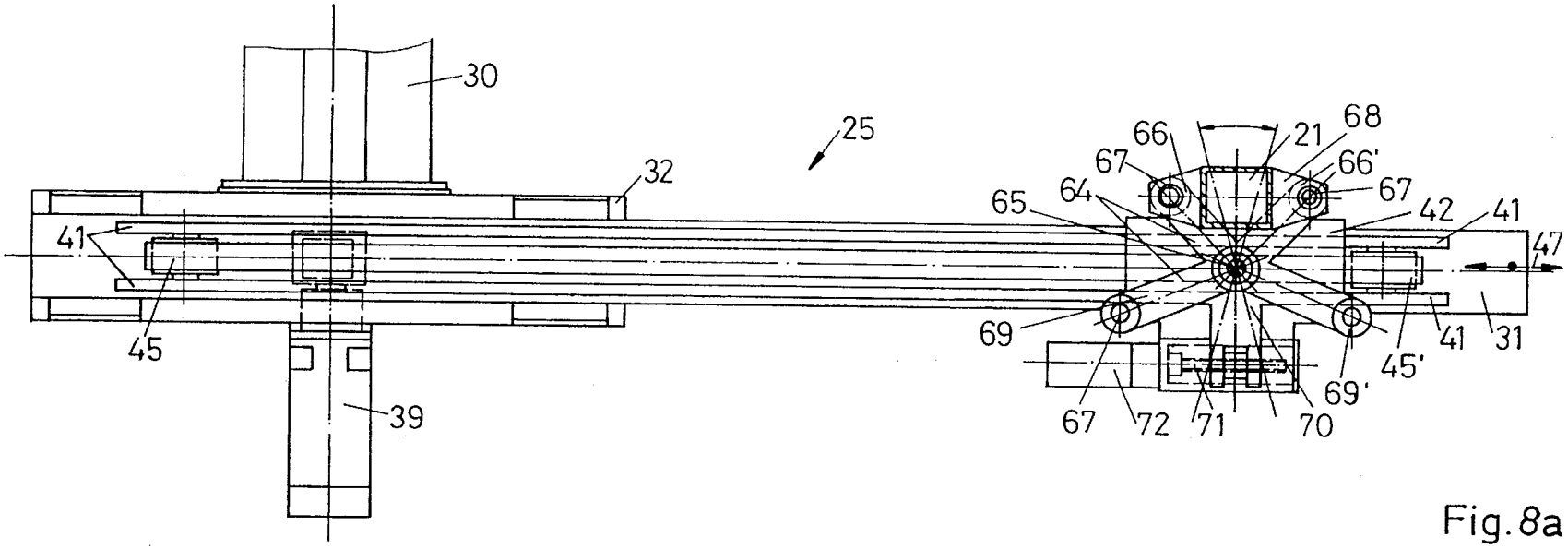
FIGS. 8*a*–8*c* show a single representation of the horizontal drive of the transport system.
Figure 8B:
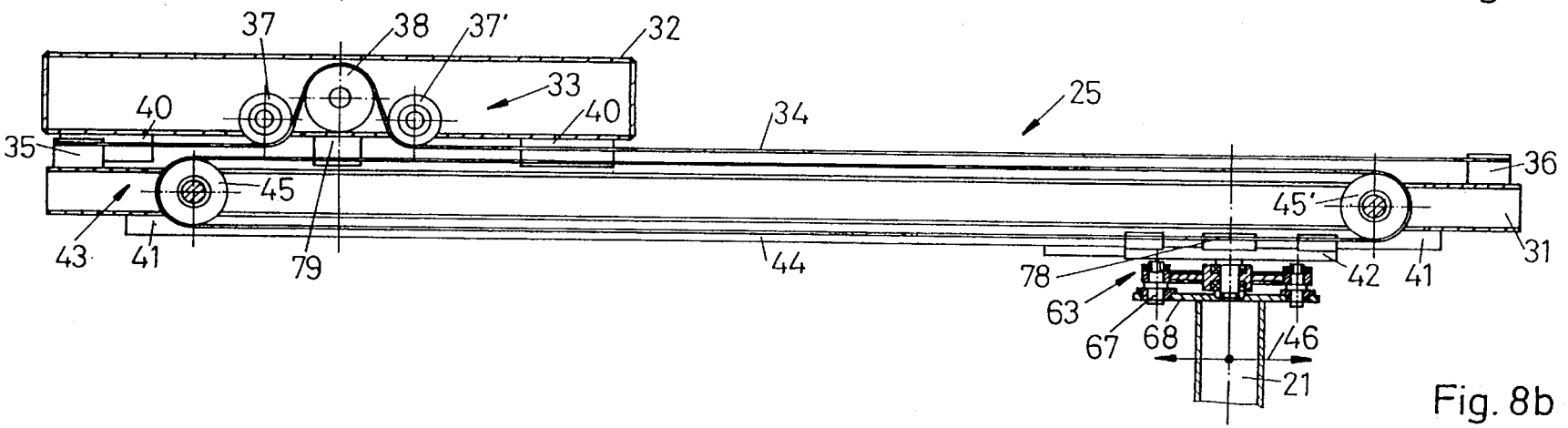

As can be seen in particular from FIG. 3, the longitudinal transport device 25 is fastened to a lifting mechanism configured as a lifting column 30. The longitudinal transport device 25 exhibits, according to the more detailed representation according to FIGS. 8*a* to 8*c*, a horizontal longitudinal member 31, which is fastened to a drive housing 32 which, for its part, is fixedly connected to the lifting column 30. By means of a first cable or belt drive 33, a cable or belt 34 is fastened at both ends 35, 36 of the horizontal longitudinal member 31 and driven, via two deflection rollers 37, 37' and a drive pinion 38, by a drive motor 39. If the drive pinion 38 rotates, then the belt 34 and hence the horizontal longitudinal member 31 is horizontally displaced, the direction of displacement conforming to the revolution direction of the drive pinion 38. The horizontal longitudinal member 31 is thereby able to perform a horizontal stroke motion over virtually its entire length. In FIGS. 8*a*, 8*b*, the longitudinal member 31 is aligned virtually fully to the right.

As can especially be seen from FIGS. 8*a* and 8*b*, the longitudinal member 31 (bearing 40), which is horizontally transportable and is mounted on the drive housing 32, exhibits, for its part, guide means 41, which allow a horizontal longitudinal transport of a slide 42. The slide 42 serves to receive the suction beam 21 or cross-tie 21, or a gripper arrangement 23 represented in FIG. 5.

The longitudinal transport of the slide 42 in the guide means 41 is realized, once again, using a cable or belt drive 43 which is fastened by means of a clamping apparatus 78, a belt 44, for example, being guided by means of two deflection rollers 45, 45', which are once again located on the end side of the horizontal longitudinal member. The belt 44 is fastened by a clamping device 79 to the drive housing 32. Upon the horizontal longitudinal displacement of the longitudinal member 31, the belt 44 is automatically moved along, and hence also the slide 42 which is fastened thereto. The slide 42 thereby covers twice the distance covered by the longitudinal member 31 (doubling of stroke).

The slide 42 represented in FIG. 8*a* in side view and in FIG. 8*b* in top view is consequently displaced in the guides 41 over virtually the entire length of the longitudinal member 31. This is indicated by an arrow 46 in FIG. 8*b*.

Figure 8C:
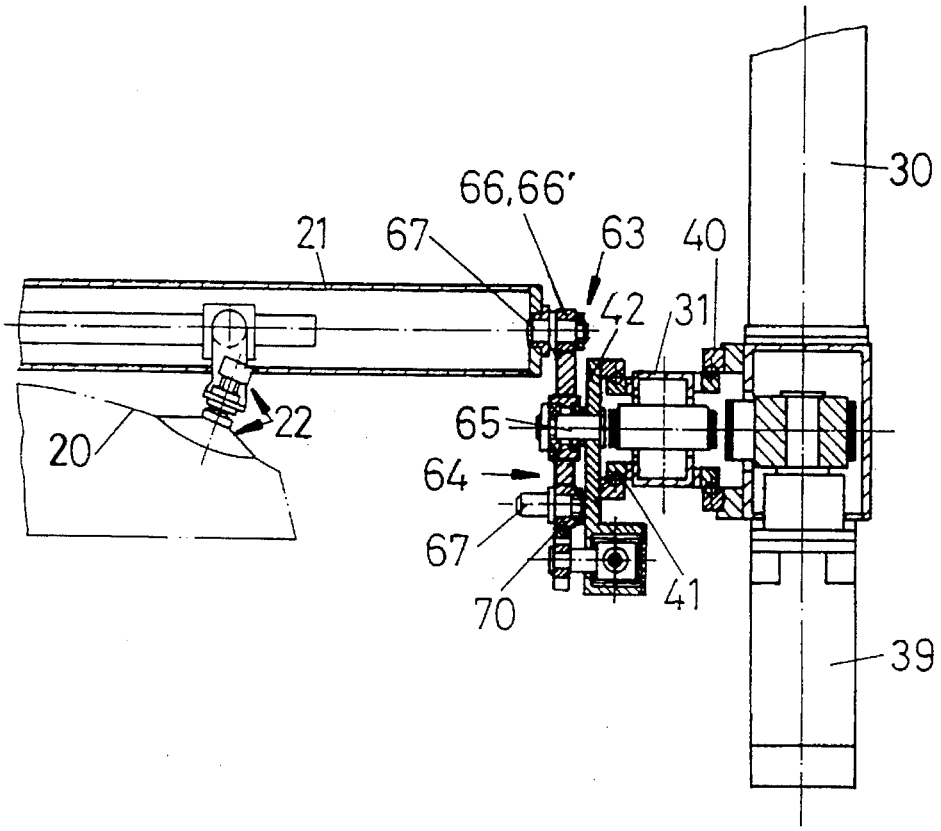

The longitudinal transport device 25 represented in FIG. 8*a* in side view and in FIG. 8*b* in top view, in FIG. 8*c* in front view, consequently executes a double longitudinal motion, which is composed, on the one hand, of the longitudinal displacement of the horizontal longitudinal member 31 itself (arrow 47) and of the additional motion of the supporting slide 42 on the horizontal longitudinal member 31 (arrow 46).

Consequently, in FIGS. 1 and 2, the horizontal longitudinal transport device 25 is represented in various positions in the respective machining stage 3 to 7. In the first machining stage 3, for example, there is located in the first upright region 14, 14' a transport system 24 with associated longitudinal transport device 25, the horizontal longitudinal member 31 of which is aligned virtually fully in the direction of transport (arrow 27) of the workpiece, the suction beam or cross-tie 21 being located precisely in the machining region of the dies 10, 11. Consequently, the workpiece depositing position is here shown in the first machining stage 3.

FIGS. 1 and 2 show further transport systems 24, which are disposed between the further press uprights 15 to 19 and the horizontal longitudinal member 31 of which is positioned, with supporting slides 42 located thereon for the suction beams 21, in the various machining settings, as is described in greater detail in connection with the lifting/transverse motion device to be explained below.

From FIGS. 1 to 3, the structure of the lifting/transverse motion device 26 of the transport system 24 can be seen in greater detail. This combined lifting/transverse motion device 26 comprises a supporting slide 49, which is guided in a horizontal housing 48 and receives for its part, in vertical guide means 50, the lifting column 30. Using a first drive motor 51, a spindle 52 is driven, which interacts with a spindle nut 53 fastened to the supporting slide 49 for the horizontal transverse displacement of said supporting slide. In FIG. 3, the supporting slide 49 can consequently be displaced transversely to the direction of transport, corresponding to the arrow 29, over the entire length of the drive spindles 52. As a result of this transverse motion, a closing/opening motion, in particular for a gripper arrangement, is performed, as is represented in greater detail in FIG. 5. This corresponds to a 3-axial transfer operation.

Insofar as the press arrangement works with a 2-axial suction beam operation, the transverse motion (arrow 29) of the supporting slide 49 can be used as a set-up axis for the conversion of the dies.

Besides the transverse drive 51 to 53 for the slide 49, the combined lifting/transverse motion device exhibits a further drive motor 54, which represents a spline shaft 55 for a lift drive of the lifting column 30 (arrow 28). For this purpose, a sliding ball shaft is also, for example, employed. The drive motors 51, 54 are configured as high-precision drive motors, which allow programmable motional sequences in their motions. This is done, for example, using programmable servomotors 51, 54.

The combined lifting/transverse motion device 26 is fastened, for its part, to an additional, vertically adjustable bracket 56, which exhibits a vertical adjustment mechanism 57 of its own as a set-up axis. This vertical adjustment mechanism comprises, in particular, a spindle drive 58 with deflection gearing 59, a common drive motor 60 being provided for the transport systems 24 disposed on both sides of the press uprights.

In place of the previously described system of a lifting/transverse motion device 26, a similar drive system can also, of course, be used. In this connection, reference is made, for example, to the content of DE 32 33 428 C2, which demonstrates a combined lift drive with longitudinal drive by means of a belt drive. Such an arrangement would likewise, by analogy, be usable and is shown diagrammatically in FIG. 7.

Figure 4A:
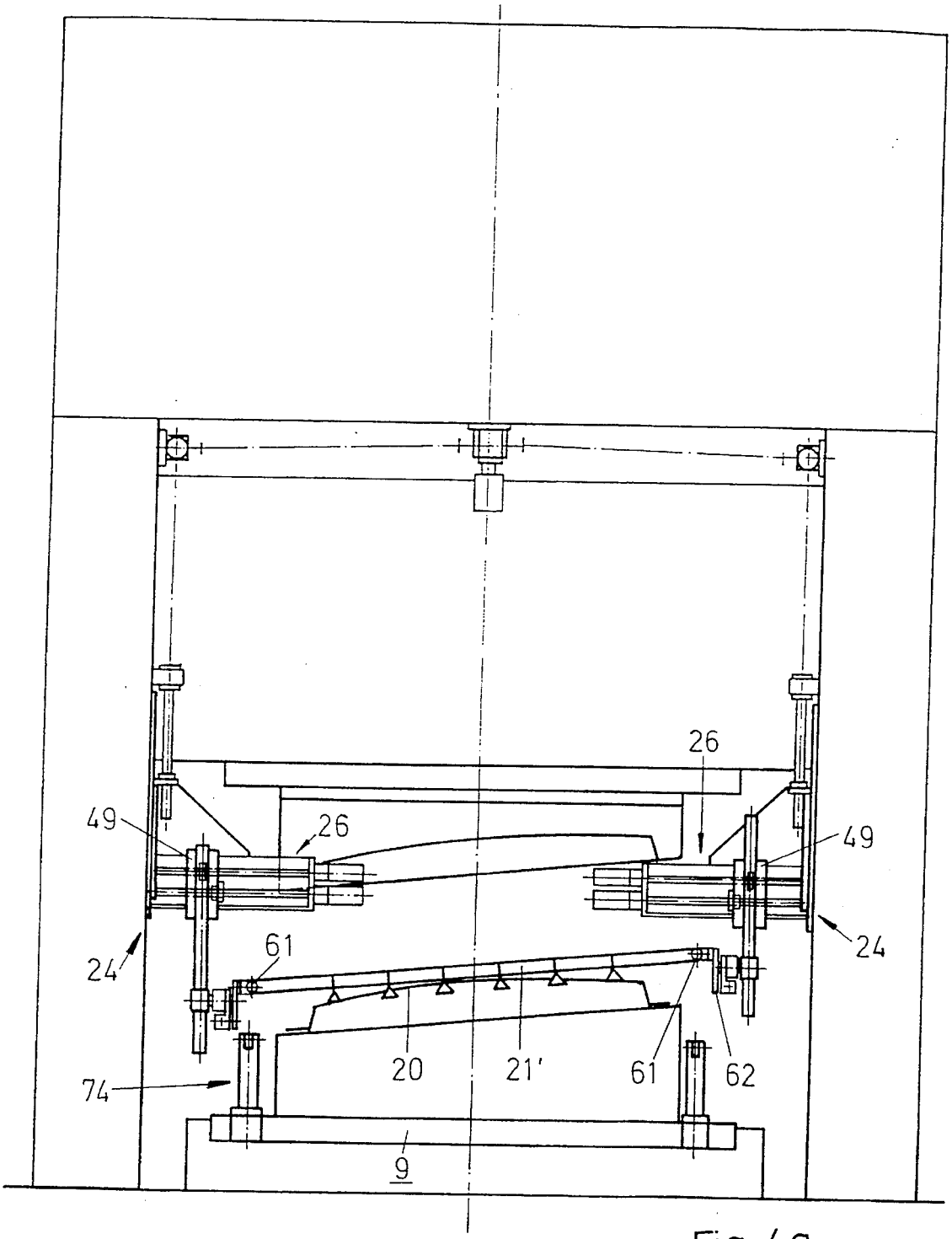
FIG. 4*a* shows a parts-withdrawal with suction beams and swiveling transversely to the direction of transport, corresponding to the section D—D in FIG. 1.
Figure 4B:
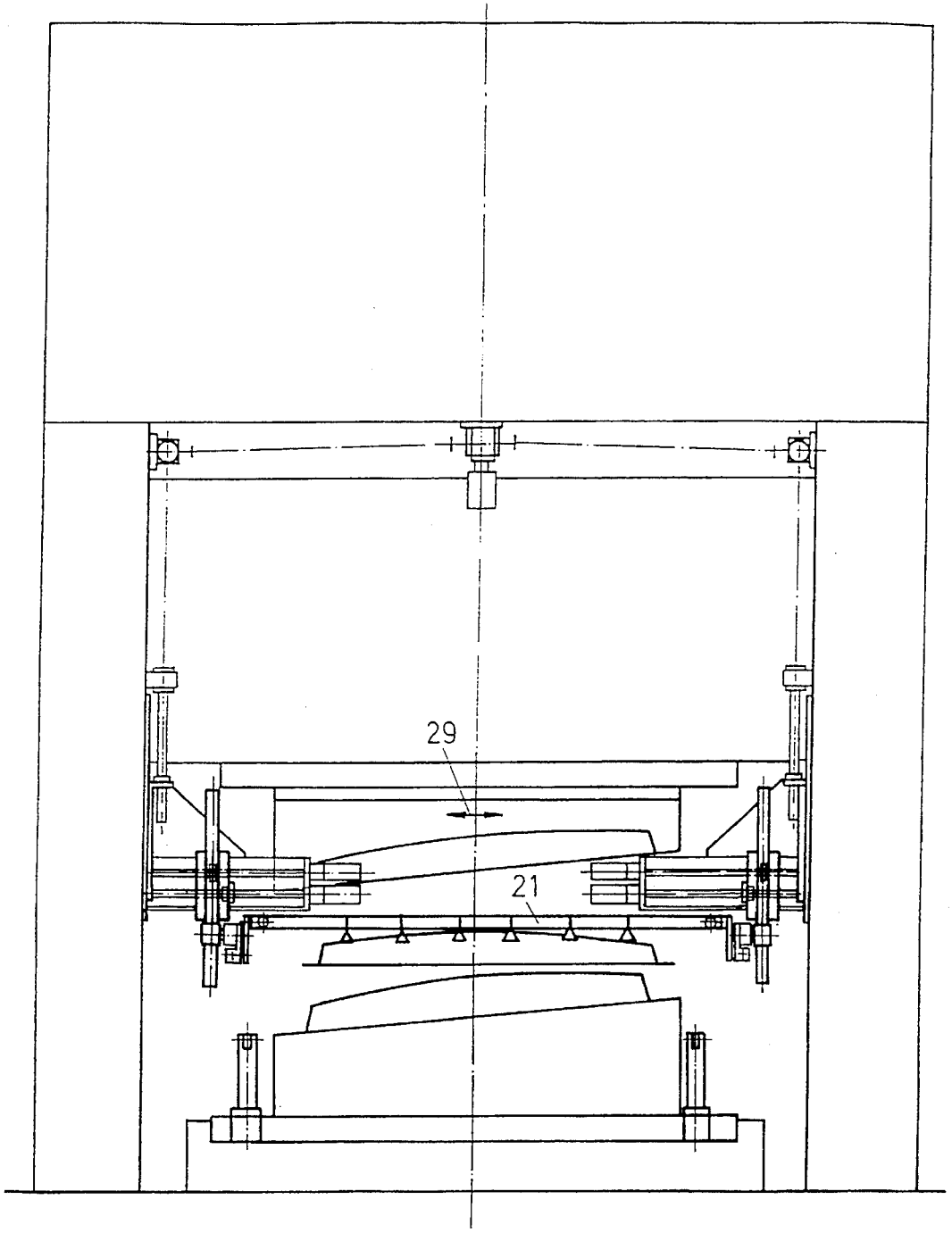
FIG. 4*b* shows a parts-transport with suction beams swiveled into the horizontal, corresponding to the section D—D in FIG. 1.

The representation of the invention according to FIGS. 4*a*, 4*b* shows a further application option for the invention on the basis of the transport system 24 according to the invention. Here too, a suction beam drive, which in itself is 2-axial, is shown in front view, the suction beam 21, due to the universal actuation of the transport system 24, being able to be shifted from its usually horizontal position into a slant 21'. For this purpose, the lifting mechanisms of the lifting/transverse motion devices 26 disposed on both sides are actuated differently, so that, in FIG. 4, the right-hand lifting mechanism occupies, for example, a higher position than the left-hand lifting mechanism. In order to equalize the slant of the suction beam 21', Cardan joints 61 are necessary, however, at the ends of the suction beam, which Cardan joints create a passage to the adjacent connecting flange 62. The slant represented in FIG. 4*a* must also, of course, be compensated for by a transversely directed horizontal motion (arrow 29) of the transverse transport device 26, i.e. the supporting slide 49 performs a matching transverse motion (FIG. 4*b*). This transverse motion (arrow 29) can also be effected independently of the slant, where the parts-production makes this necessary.

As mentioned previously, according to the representation shown in to FIG. 5, in place of the suction beam operation, a gripper arrangement 23 can also be employed for the transportation of the workpiece. For the conversion between the suction beam operation according to FIG. 3 and the gripper operation according to FIG. 5, the longitudinal transport device 25 suspended from the lifting column 30 exhibits, on its supporting slide 42, a coupling device 63, as is represented in greater detail in FIGS. 8*a* to 8*c*. This coupling device 63 comprises, in particular, a swivel cross 64, which is mounted by means of a central bearing bolt 65 pivotably on the supporting slide 42. The swivel cross 64 exhibits two upper arms 66, 66', having respectively a connecting bolt 67 for the fastening of a transverse flange 68 for fastening the suction beam 21. The two lower arms 69, 69' exhibit, for their part, connecting bolts 67, to which a gripper arrangement has to be fastened, which is not represented in greater detail in FIGS. 8*a* to 8*c*. The swivel cross 64 is consequently prepared to receive both a suction beam 21 and a gripper arrangement 23, the former being represented in FIGS. 1 to 4 and FIGS. 8 and the latter in FIG. 5.

According to the arrangement shown in FIGS. 8*a* to 8*c*, a pivotability of the swivel cross 64 about the central bearing bolt 65 is possible. For this purpose, the swivel cross 64 exhibits a downwardly directed swivel arm 70, represented in FIG. 8*a* and FIG. 8*c*, which is pivoted by means of a spindle 71 and a spindle drive 72 about the bearing axle 65. The suction beam 21 is thereby able to perform a swivel motion about the bearing axle 65.

In FIGS. 3 to 5, there are indicated on the sliding tables additional pegging holders 74, onto which the suction beams or the gripper arrangements can be pegged for the changing of the die.

The representation of the invention according to FIGS. 1 and 2 illustrates the versatility of the transport system according to the invention, which is located between each press upright region. Thus, for example, in the first machining stage 3, the workpiece is placed onto the bottom die 10 by the transport system 24 disposed between the press uprights 14, 14', whilst in the subsequent machining stage 4, at the same time, the workpiece is placed onto the bottom die by the further transport device disposed between the press uprights 15, 15'. At the same time, the transport system disposed between the press uprights 16, 16' transports the workpiece from the machining stage 4 to the machining stage 5, from which specifically that workpiece which has already been machined in this machining stage 5 is withdrawn by the transport unit disposed between the press uprights 17, 17'. At the same time, the transport gear disposed between the press uprights 18, 18' withdraws the workpiece disposed in the machining stage 6 and supplies it to the machining stage 7, in which specifically the finished workpiece is withdrawn by the transport gear disposed between the press uprights 19, 19'.

It is consequently apparent from FIG. 1 that the individual press rams are disposed also at different working heights, i.e. in different machining sequences. Consequently, the actual pressing cycle on the workpiece also takes place at the individual machining stations at different times. For example, in the machining stage 5, the press ram is located precisely in the upper dead center.

Figure 6:
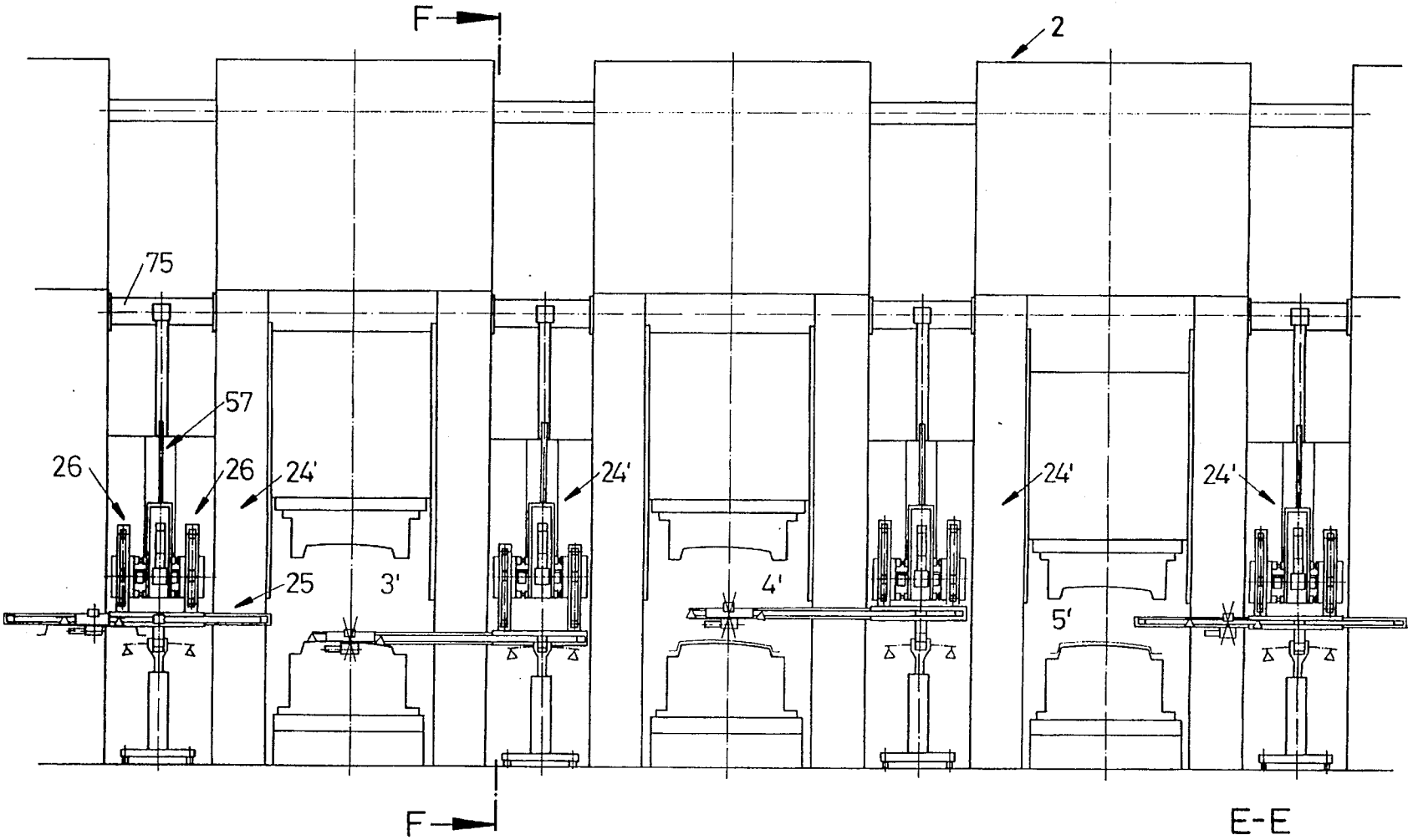
FIG. 6 shows a longitudinal section through a press line comprising linked individual presses, according to the section E—E in FIG. 7.

According to the representation of the invention in FIG. 6, the transport system 24 according to the invention can also be located between the machining stages of a press line 2. The transport systems 24 can herein be constructed basically the same as previously described, each transport system 24 once again attending to the machining stages respectively adjoined by it to left and right, as is apparent from FIG. 6. Between the three machining stages 3' to 5' represented in FIG. 6, the transport systems 24 are consequently fastened to associated fastening members 75, which take the place of the press uprights in the previously described illustrative embodiments.

In order to be able to bridge the large transport paths between the individual press stages, according to the representation in FIG. 6, transport systems 24' are provided, which likewise respectively comprise a longitudinal transport device 25 such as previously described, which is suspended however, for better weight distribution, from two mutually adjacent lifting/transverse motion devices 26. Both lifting/transverse motion devices 26 can then be moved up and down, as a set-up axis, by means of a common vertical adjustment mechanism 57.

Figure 7:
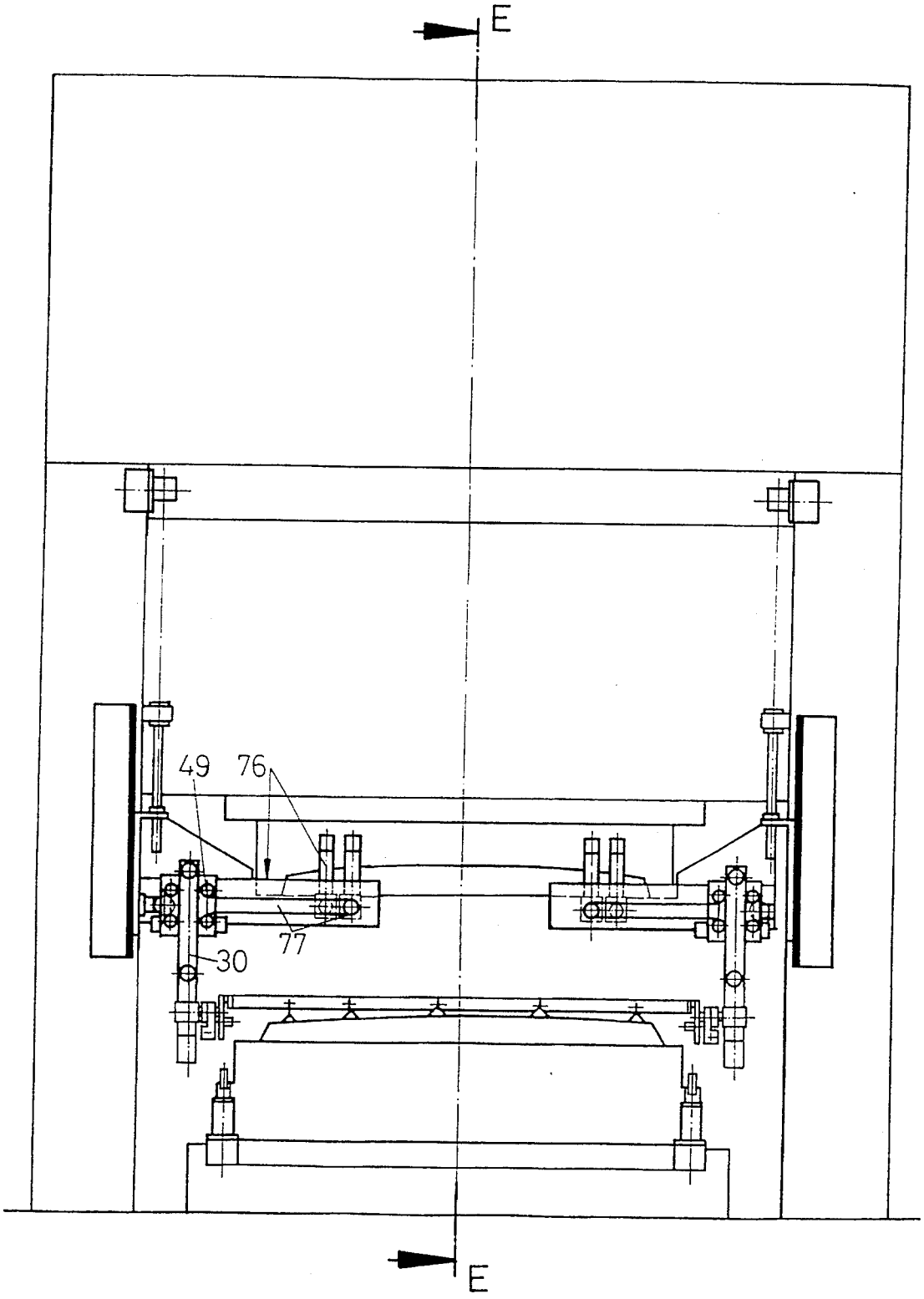
FIG. 7 shows a view in the direction of transport, corresponding to the section F—F in FIG. 6, of a linked press line.

According to the representation according to FIG. 7, as a section along the sectional line F—F in FIG. 6, the combined lifting/transverse motion device is constructed according to the system as is described in DE 32 33 428 C2. In place of the spindle drives described with respect to FIG. 3, in the illustrative embodiment according to FIG. 7 there is provided a first belt drive 76 for performing the horizontal transverse motion (arrow 29) of the supporting slide 49, and a second belt drive 77, which performs the lifting motion of the lifting column 30 by means of deflection rollers within the slide 49 or on the end side of the lifting column 30. As regards the working method, reference is expressly made to the previously stated patent specification of the applicant, the content of which is made the content of the present application.

Further details of the invention are derived from more detailed representations in the drawings, to which reference is herewith expressly made. Otherwise, the invention is not however restricted to that illustrative embodiment which has been represented and described, but rather also embraces all expert refinements within the framework of the proprietary-right claims.

1 LP-press
2 press line
3–7 machining stage.
9 sliding table
10 bottom die
11 top die
12 press ram
13 headpiece
14–19 press upright
14'–19' press upright
20 workpiece
21 suction beam/cross-tie
22 suction spiders/magnet holders
23 gripper arrangement
24 transport system
25 longitudinal transport device
26 lifting/transverse motion device
27 direction of transport of the workpiece
28 vertical direction
29 transverse motion
30 lifting column
31 horizontal longitudinal member
32 drive housing
33 cable or belt drive
34 cable/belt
35, 36 end region of 31
37 deflection roller
38 drive pinion
39 drive motor
40 bearing
41 guide means
42 slide
43 cable/belt drive
44 belt
45, 45' deflection rollers
46, 47 arrow
48 horizontal guide housing
49 supporting slide
50 vertical guide means
51 drive motor

52 spindle
53 spindle motor
54 drive motor
55 spindle
56 bracket
57 vertical adjustment mechanism
58 spindle drive
59 deflection gearing
60 drive motor
61 Cardan joint
62 connecting flange
63 coupling device
64 swivel cross
65 bearing bolt
66 upper arm
67 connecting bolt
68 transverse flange
69 lower arm
70 swivel arm
71 spindle
72 spindle drive
74 pegging holder
75 fastening member
76 first belt drive
77 second belt drive
78, 79 clamping device

We claim:

1. A transport system for transporting workpieces through machining stations of a press device, the transport system comprising at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece in a transport direction of the workpiece and having a horizontally extending extension arm for transporting the workpiece between machining stations, the extension arm including:

guide means; and a transport slide for transporting the workpiece in the transport direction, the transport slide being disposed on the guide means for being longitudinally movable thereon, the transport slide further having receiving means thereon including one of a suction beam and a gripper arrangement for effecting a reception of the workpiece by the longitudinal transport device;

a lifting mechanism operatively connected to the longitudinal transport device for effecting a vertical motion of the workpiece; and a closing-opening mechanism operatively connected to the longitudinal transport device and the lifting mechanism for effecting a transverse motion of the workpiece with respect to the transport direction thereof.

2. The transport system according to claim 1, wherein:

the longitudinal transport device is effective for performing a horizontal transport motion running in and counter to the transport direction; and the closing-opening mechanism comprises a motion device for effecting a horizontal transverse motion of the workpiece with respect to the transport direction.

3. The transport system according to claim 2, wherein the motion device is a structural combination of the lifting mechanism and the closing-opening mechanism.

4. A transport system for transporting workpieces through machining stations of a press device, the transport system comprising at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece running in and counter to a transport direction of the workpiece and having a horizontally extending extension arm for transporting the workpiece between machining stations, the extension arm including:

guide means; and a transport slide for transporting the workpiece in the transport direction, the transport slide being disposed on the guide means for being longitudinally movable thereon, the transport slide further having receiving means thereon including one of a suction beam and a gripper arrangement for effecting a reception of the workpiece by the longitudinal transport device;

a lifting mechanism operatively connected to the longitudinal transport device for effecting a vertical motion of the workpiece; and a closing-opening mechanism operatively connected to the longitudinal transport device and the lifting mechanism and comprising a motion device for effecting a horizontal transverse motion of the workpiece with respect to the transport direction thereof.

5. The transport system according to claim 3, wherein the longitudinal transport device further includes guide devices thereon operatively connected to the extension arm for effecting a relative motion of the extension arm running in and counter to the transport direction with respect to predetermined other parts of the longitudinal transport device.

6. The transport system according to claim 3, wherein the extension arm further includes:

a slide belt drive operatively connected to the transport slide for longitudinally moving the transport slide; and a plurality of deflection rollers disposed at respective ends of the extension arm, the slide belt drive being disposed about and guided by the deflection rollers.

7. The transport system according to claim 5, wherein the longitudinal transport device further includes one of an arm belt drive and a rack and pinion drive for longitudinally moving the extension arm.

8. A transport system for transporting workpieces through machining stations of a press device, the transport system comprising at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece running in and counter to a transport direction of the workpiece, the longitudinal transport device having receiving means thereon including one of a suction beam and a gripper arrangement for effecting a reception of the workpiece by the longitudinal transport device;

a lifting mechanism operatively connected to the longitudinal transport device for effecting a vertical motion of the workpiece; and a closing-opening mechanism operatively connected to the longitudinal transport device and the lifting mechanism and comprising a motion device for effecting a horizontal transverse motion of the workpiece with respect to the transport direction thereof, the motion device including:

a lifting column operatively connected to the longitudinal transport device;

a lift drive operatively connected to the lifting column for effecting a vertical movement of the lifting column;

a receiving apparatus including a supporting slide, the lifting column being vertically guided in the supporting slide;

a transverse drive operatively connected to the supporting slide for effecting a transverse motion of the supporting slide with respect to the transport direction independently of the lift drive; and a horizontal transverse guide device, the supporting slide being transversely guided in the horizontal transverse guide device.

9. The transport system according to claim 8, wherein the transport device further includes:

bracket guide means; and a vertically adjustable bracket being disposed on the bracket guide means for being vertically movable thereon, the bracket thereby being effective as a set-up device for changing a die in a corresponding machining station.

10. The transport system according to claim 8, wherein:

the transverse drive is a horizontal transverse drive comprising one of a transverse belt drive and a transverse spindle drive; and the motion device further includes programmable servomotors operatively connected to the transverse drive for controlling an actuation thereof.

11. The transport system according to claim 8, wherein the lift drive includes:

one of a cable drive, a belt drive and a spline shaft drive having a gearwheel drive; and programmable servomotors operatively connected to the lift drive for controlling an actuation thereof.

12. The transport system according to claim 8, wherein the transverse drive includes a traction mechanism comprising:

a belt drive; and deflection rollers disposed at an end side of the motion device, the belt drive being disposed about and guided by the deflection rollers.

13. The transport system according to claim 8, wherein the lift drive includes a traction mechanism comprising:

a belt drive; and bearings disposed at end side of the motion device, the belt drive being disposed about and guided by the bearings so as to form, at the lifting column, an upper and lower deflection loop which is adjustable in length.

14. A transport system for transporting workpieces through machining stations of a press device, the transport system comprising at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece running in and counter to a transport direction of the workpiece, the longitudinal transport device having receiving means thereon including one of a suction beam and a gripper arrangement for effecting a reception of the workpiece by the longitudinal transport device;

a lifting mechanism operatively connected to the longitudinal transport device for effecting a vertical motion of the workpiece; and a closing-opening mechanism operatively connected to the longitudinal transport device and the lifting mechanism and comprising a motion device for effecting a horizontal transverse motion of the workpiece with respect to the transport direction thereof, the motion device being configured to be disposed between one of press uprights of a multiple-die press and individual presses of a press line.

15. The transport system according to claim 1, wherein the transport device further includes a coupling device thereon for coupling the receiving means thereto.

16. The transport system according to claim 1, wherein the coupling device comprises one of a connecting flange and a swivel device including receiving elements thereon which are one of adapted to receive a suction beam fitted with a suction spider and adapted to receive a gripper bar fitted with gripper elements.

17. The transport system according to claim 16, wherein the swivel device includes:

a swivel cross configured as a receiving flange for the suction beam and the gripper arrangement;

a swivel drive operatively connected to the swivel cross for driving the swivel cross;

a horizontal bearing axle, the swivel cross being mounted on the bearing axle and being pivotable thereabout;

a spindle drive operatively connected to the swivel cross for pivoting the swivel cross about the bearing axle; and a programmable motor operatively connected to the spindle drive for controlling an actuation thereof.

18. A transport system for transporting workpieces through machining stations of a press device, the transport system comprising at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece running in and counter to a transport direction of the workpiece, the longitudinal transport device having receiving means thereon including one of a suction beam and a gripper arrangement for effecting a reception of the workpiece by the longitudinal transport device, the longitudinal transport device further including equalization joints operatively connected to the coupling device for equalizing aslant of the workpiece;

a lifting mechanism operatively connected to the longitudinal transport device for effecting a vertical motion of the workpiece; and a closing-opening mechanism operatively connected to the longitudinal transport device and the lifting mechanism and comprising a motion device for effecting a horizontal transverse motion of the workpiece with respect to the transport direction thereof, the motion device being configured such that one motion device is disposed on each of two sides of a die chamber of the press device thereby resulting in two motion devices being disposed in the die chamber, the two motion devices being controllable independently of one another.

19. A transport system for transporting workpieces through machining stations of a press device, the transport system comprising at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece running in and counter to a transport direction of the workpiece, the longitudinal transport device having receiving means thereon including one of a suction beam and a gripper arrangement for effecting a reception of the workpiece by the longitudinal transport device;

a lifting mechanism operatively connected to the longitudinal transport device for effecting a vertical motion of the workpiece; and a closing-opening mechanism operatively connected to the longitudinal transport device and the lifting mechanism and comprising a motion device for effecting a horizontal transverse motion of the workpiece with respect to the transport direction thereof, the motion device being configured such that one motion device is disposed on each of two sides of a die chamber of the press device thereby resulting in two motion devices being disposed in the die chamber, the two motion devices being controllable independently of one another and being configured to perform a relative transverse motion with respect to one another for further changing a position of the workpiece.

20. A transport system for transporting workpieces through machining stations of a press device, the transport system comprising at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece in a transport direction of the workpiece, the longitudinal transport device being configured such that one longitudinal transport device is disposed on each of two sides of a die chamber of the press device thereby resulting in two longitudinal transport devices being disposed in the die chamber, the two longitudinal transport devices being adapted to effect different horizontal longitudinal motions of the workpiece with respect to one another;

a lifting mechanism operatively connected to the longitudinal transport device for effecting a vertical motion of the workpiece; and a closing-opening mechanism operatively connected to the longitudinal transport device and the lifting mechanism for effecting a transverse motion of the workpiece with respect to the transport direction thereof.

21. A transport system for transporting workpieces through machining stations of a press device, the transport system comprising:

at least one independent transport device dedicated to each machining station, the transport device being effective for receiving and transporting a workpiece in at least one of a 2-axial and a 3-axial transport motion and including:

a longitudinal transport device for effecting a horizontal longitudinal motion of the workpiece running in and counter to a transport direction of the workpiece, the longitudinal transport device having receiving means thereon including one of a suction beam and a gripper arrangement for effecting a reception of the workpiece by the longitudinal transport device;

a lifting mechanism operatively connected to the longitudinal transport device for effecting a vertical motion of the workpiece; and a closing-opening mechanism operatively connected to the longitudinal transport device and the lifting mechanism and comprising a motion device for effecting a horizontal transverse motion of the workpiece with respect to the transport direction thereof; and a bracket means connected to the transport device and including:

bracket guide means; and a vertically adjustable bracket being disposed on the bracket guide means for being vertically movable thereon, the bracket thereby being effective as a set-up device for changing a die in a corresponding machining station.

22. The transport system according to claim 15, wherein the coupling device includes:

a swivel cross configured as a receiving flange for the suction beam and the gripper arrangement;

a swivel drive operatively connected to the swivel cross for driving the swivel cross;

a horizontal bearing axle, the swivel cross being mounted on the bearing axle and being pivotable thereabout;

a spindle drive operatively connected to the swivel cross for pivoting the swivel cross about the bearing axle; and a programmable motor operatively connected to the spindle drive for controlling an actuation thereof.

* * * * *